US008430364B1

(12) United States Patent
Ashkenazi et al.

(10) Patent No.: US 8,430,364 B1
(45) Date of Patent: Apr. 30, 2013

(54) ROLLER ASSEMBLY FOR A RAILWAY SWITCH

(75) Inventors: Avraham Ashkenazi, Virginia Beach, VA (US); Seth Fleishman, Norfolk, VA (US); Ivo Chládek, Kolová (CZ); Václav Suchan, Královské Poříčí (CZ); Radek Lucovič, Slovanská (CZ)

(73) Assignees: Eco-Production Vresova Spol. S R O, Sokolov (CZ); IAT International, Inc., Norfolk, VA (US)

( * ) Notice: Subject to any disclaimer, the term of this patent is extended or adjusted under 35 U.S.C. 154(b) by 0 days.

(21) Appl. No.: 13/306,258

(22) Filed: Nov. 29, 2011

(51) Int. Cl.
*E01B 7/00* (2006.01)

(52) U.S. Cl.
USPC ..... 246/453; 246/430

(58) Field of Classification Search ..... 246/430, 246/453
See application file for complete search history.

(56) References Cited

U.S. PATENT DOCUMENTS

| | | | | | |
|---|---|---|---|---|---|
| 4,159,090 | A * | 6/1979 | Pirker | ..... | 246/391 |
| 5,390,881 | A * | 2/1995 | Benenowski et al. | ..... | 246/453 |
| 5,499,786 | A * | 3/1996 | Durchschlag et al. | ..... | 246/448 |
| 5,509,626 | A * | 4/1996 | Fodor | ..... | 246/453 |
| 5,562,267 | A * | 10/1996 | Heim et al. | ..... | 246/415 R |
| 5,628,480 | A * | 5/1997 | Vrsecky et al. | ..... | 246/453 |
| 6,189,840 | B1 * | 2/2001 | Mantovan et al. | ..... | 246/453 |
| 6,464,177 | B1 * | 10/2002 | Heim | ..... | 246/453 |
| 6,616,105 | B2 * | 9/2003 | Grunwald et al. | ..... | 246/430 |
| 2008/0087773 | A1 * | 4/2008 | Meyer | ..... | 246/453 |

OTHER PUBLICATIONS

"The Ekoslide"; Retrieved from http://web.archive.org/web/20080724185456/http:/www.foxtrade.net/ENGLISH/innovationenE.html; Fox Trade GmbH, 2008.

* cited by examiner

*Primary Examiner* — Jason C Smith
(74) *Attorney, Agent, or Firm* — Mendelsohn, Drucker & Associates, P.C.; Kevin M. Drucker

(57) ABSTRACT

A roller assembly for facilitating movement of a switch rail between two positions. In one embodiment, the roller assembly includes a frame adapted for attachment to the switch rail and having a pocket formed therein, and an elastomer assembly, at least a portion of which is slidably disposed within the pocket. The elastomer assembly includes a roller wheel and an elastomeric block. The roller wheel travels along the surface of a tie plate when the switch rail is moved between positions. The elastomeric block is adapted to compress under a load applied to the switch rail in the direction of the tie plate, causing the roller wheel to retract in the direction of the pocket. When the weight of a train is exerted on the roller assembly, the compression of the elastomeric block causes the train to ride fully on the rails, just as if the roller assembly were not present. When no weight is exerted on the roller assembly, the roller assembly assists the switch to move freely between positions.

18 Claims, 7 Drawing Sheets

ROLLER ASSEMBLY FOR A RAILWAY SWITCH

FIELD OF THE INVENTION

The present invention relates, generally, to railway switching devices, and more particularly, to a roller assembly for a railway switch.

BACKGROUND

A railway switch (also known as a turnout or a set of points) is a mechanical assembly that permits railway trains to be guided from one track to another at a railway junction. A typical switch includes a pair of linked tapering rails called switch rails (also known as points or point blades) that lie between a pair of diverging outer rails called stock rails. In operation, the points can be moved laterally between a first position and a second position to direct a train towards or away from either a first path, defined by the left stock rail, or a second path, defined by the right stock rail.

SUMMARY OF THE INVENTION

In one embodiment, the present invention provides a roller assembly for facilitating movement of a switch rail between a first position and a second position. The roller assembly includes a frame and an elastomer assembly. The frame is adapted for attachment to the switch rail and has a pocket formed therein. At least a portion of the elastomer assembly is slidably disposed within the pocket. The elastomer assembly includes a roller wheel and an elastomeric block. The roller wheel is adapted to travel along the surface of a tie plate when the frame is attached to a switch rail and the switch rail is moved between the first position and the second position. The elastomeric block is adapted to compress under a load applied to the switch rail in the direction of the tie plate. Compression of the elastomeric block under the load causes the roller wheel to travel in the direction of the pocket.

In another embodiment, the present invention provides a roller assembly including a frame and an elastomer assembly. The frame has a pocket formed therein. At least a portion of the elastomer assembly is slidably disposed within the pocket. The elastomer assembly includes a roller wheel and an elastomeric block adapted to compress under an axial load. Compression of the elastomeric block under the load causes the roller wheel to travel in the direction of the pocket.

In a further embodiment, the present invention provides a method for facilitating movement of a switch rail between a first position and a second position. The method includes: attaching a roller assembly to a switch rail, the roller assembly including a frame having a pocket formed therein and an elastomer assembly, at least a portion of the elastomer assembly slidably disposed within the pocket; and compressing the elastomer assembly axially to cause the at least a portion of the elastomer assembly slidably disposed within the pocket to travel in the direction of the pocket.

DETAILED DESCRIPTION

Figure 1:
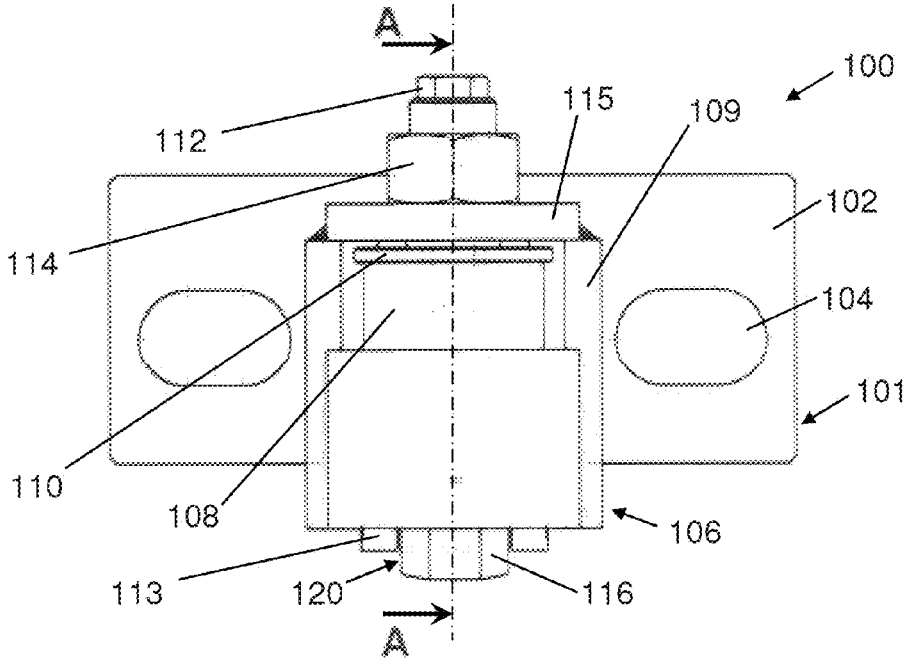
FIG. 1 is a front elevational view of a roller assembly consistent with one embodiment of the present invention.

With reference now to FIGS. 1-4, a roller assembly 100 consistent with one embodiment of the present invention will now be described. As shown, roller assembly 100 includes a frame 101 comprising a mounting plate 102 on which a pocket 106 is disposed. Pocket 106 houses elastomer assembly 120, which is removably coupled to pocket 106 via a hex nut 114.

Mounting plate 102 has a plurality of through holes 104 formed therein for mounting roller assembly 100 to a switch rail (not shown in FIGS. 1-4). Through holes 104 are desirably spaced to match existing bolt holes on the switch rail and may be elongated to permit lateral adjustment of roller assembly 100 relative to the switch rail.

Figure 5:
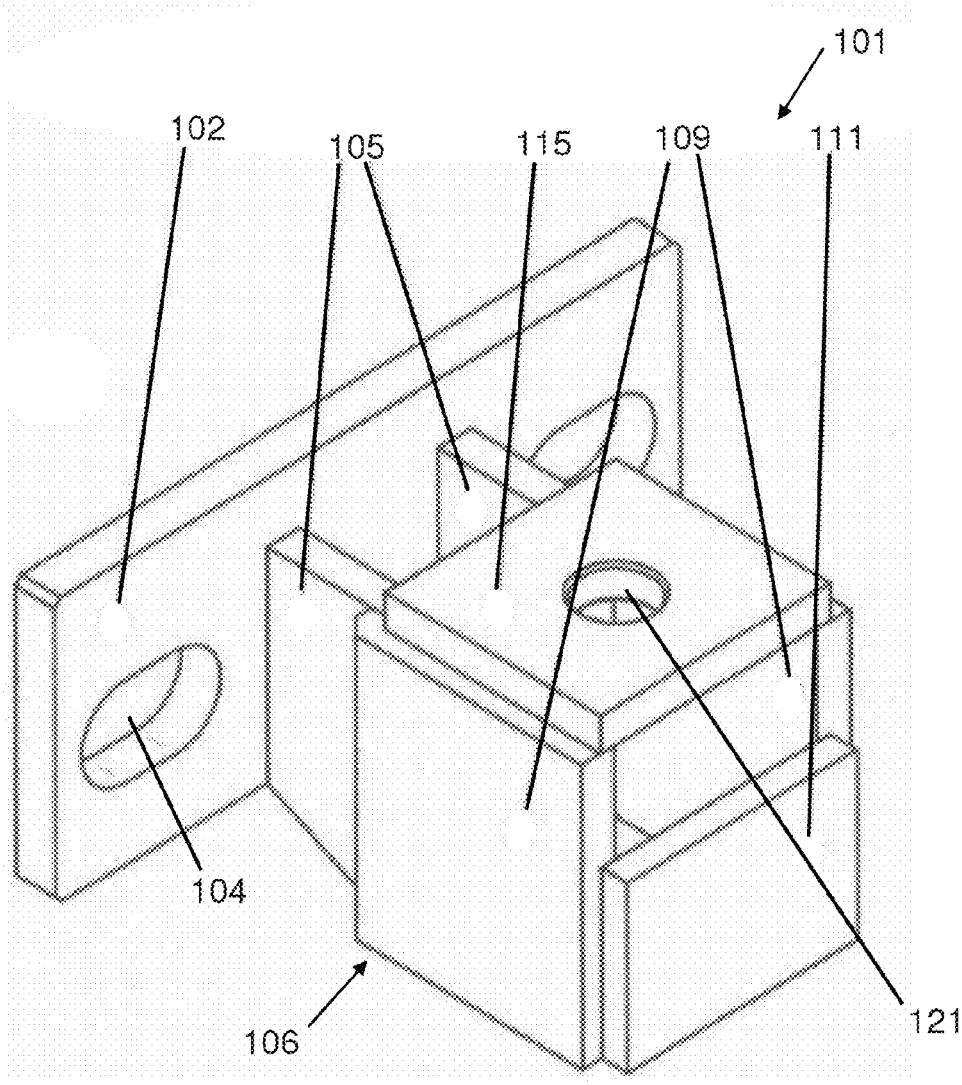
FIG. 5 is a top perspective view of the frame of FIG. 1.

The details of pocket 106 are best seen in FIG. 5. Pocket 106 is disposed on mounting plate 102 and is formed from a pair of projections 105 welded to mounting plate 102 and projecting therefrom at a 90-degree angle, a pair of sidewalls 109, a front wall 111, and a top wall 115.

Sidewalls 109 are welded to the outside surfaces of, and are disposed parallel to, projections 105. Front wall 111 is disposed parallel to mounting plate 102 and is welded to sidewalls 109, bridging sidewalls 109. In this embodiment, front wall 111 has a reduced height relative to sidewalls 109 to permit viewing and inspection of components located behind front wall 111 (e.g., elastomeric block 108). Top wall 115 is welded to the top surfaces of projections 105 and to sidewalls 109, bridging sidewalls 109. Top wall 115 has a centrally-disposed aperture 121 for receiving a shaft 112 of elastomer assembly 120, onto which hex nut 114 is removably threaded to couple elastomer assembly 120 to pocket 106. It is noted that the end of shaft 112 is fashioned into a bolt head to permit raising and lowering the height of elastomer assembly 120 within pocket 106, e.g., using a standard wrench. Shaft 112 also has a threaded portion (not shown in the drawings) adapted to receive hex nut 114 threadably thereon. It should further be noted that shaft 112 is hollow, to permit the distal end of a plunger 119 of elastomer assembly 120 to engage slidably within shaft 112 when elastomer assembly 120 is installed within pocket 106.

Figure 6:
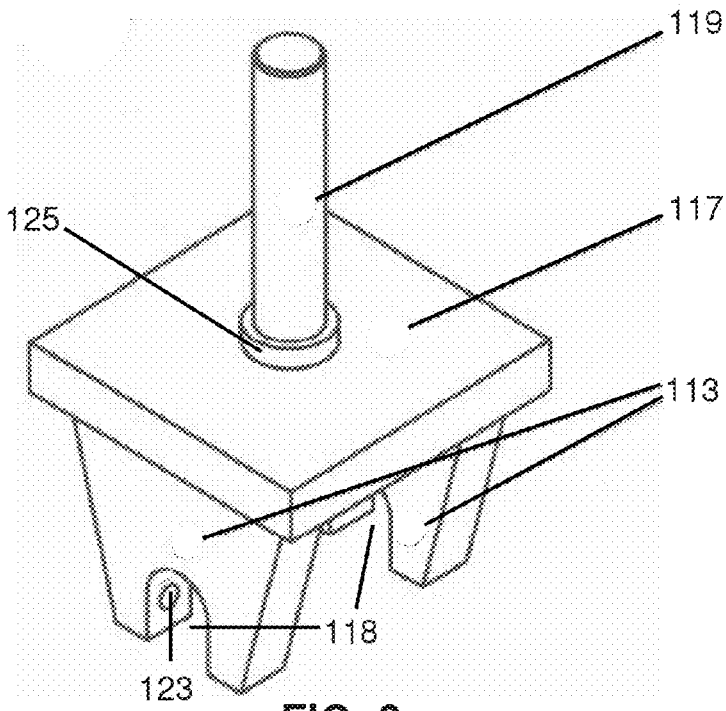
FIG. 6 is a top perspective view of a portion of the elastomer assembly of FIG. 1.
Figure 7:
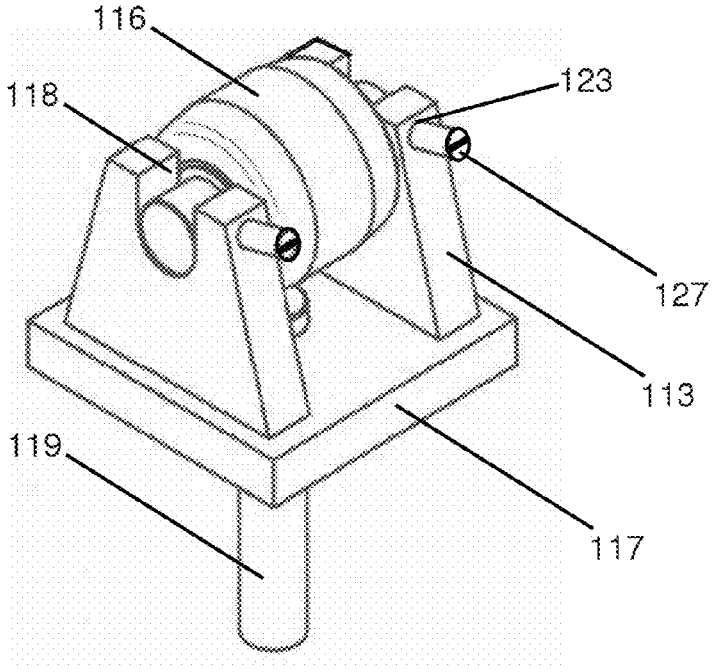
FIG. 7 is a bottom perspective view of a portion of the elastomer assembly of FIG. 1.

The details of elastomer assembly 120 will now be described. Such details are best seen in FIGS. 6-13, which show various portions of elastomer assembly 120. As shown in FIGS. 6 and 7, elastomer assembly 120 includes a base 117 coupled to plunger 119 disposed centrally thereon, with a flange portion 125 disposed at the intersection of base 117 and plunger 119. Plunger 119 is of an appropriate diameter to receive a hole 150 of an elastomeric block 108 slidably and loosely thereon. Flange portion 125 is of an appropriate diameter to receive hole 150 of elastomeric block 108 slidably and snugly thereon (elastomeric block 108 will be discussed below in further detail with reference to FIGS. 11-13). A pair of guide plates 113 project from the opposite side of base 117 from which plunger 119 projects. Guide plates 113 are generally trapezoidal members tapering inward distally, each guide plate 113 having a U-shaped notched region 118 at its distal end. The pair of guide plates 113 are arranged to hold a roller unit 116. Each guide plate 113 also has a pair of screw holes 123 formed therein, each screw hole 123 beginning at a tapered side of guide plate 113 near the narrower, distal end thereof, passing through guide plate 113, and ending inside notched region 118. Each screw hole 123 has a screw 127 passing therethrough, and screws 127 retain roller unit 116 within notched region 118 of guide plate 113 when screws 127 are fully threaded into screw holes 123.

Figure 8:
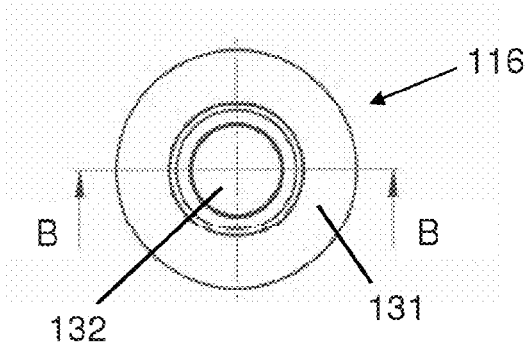
FIG. 8 is an end view of the roller unit of FIG. 1.
Figure 9:
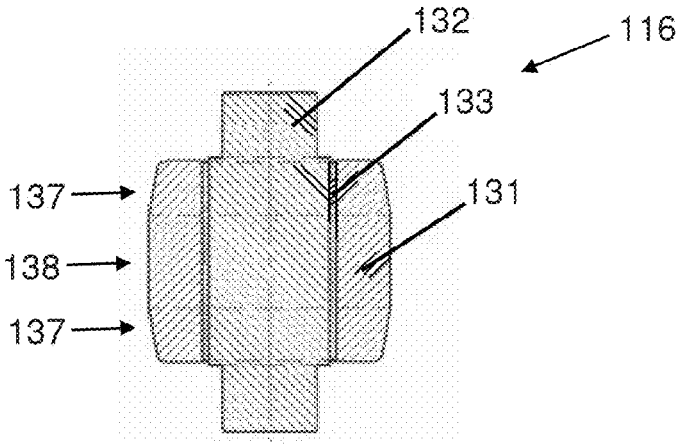
FIG. 9 is a cross-sectional view of the roller unit of FIG. 8 taken along plane B-B of FIG. 8.
Figure 10:
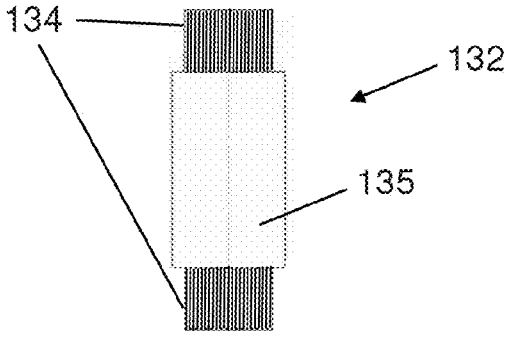
FIG. 10 is a plan view of the pivot of FIG. 8.

As shown in FIGS. 8-10, roller unit 116 includes a roller wheel 131 having a pivot 132 disposed within a central aperture 133 thereof. Roller wheel 131 has a central portion 138 with a substantially uniform diameter and shoulder portions 137 that taper inward distally. Pivot 132 has a central portion 135 and end portions 134. End portions 134 have textured (e.g., grooved or knurled) arcuate surfaces, which assist in secure engagement with the ends of screws 127 that retain pivot 132 within notched region 118 to restrict rotation of pivot 132 and hold roller unit 116 in place. Central portion 135 has a smooth arcuate surface to permit free rotation of roller wheel 131 relative to pivot 132, which remains stationary while disposed within central aperture 133 of roller wheel 131 and held in place by screws 127.

Figure 2:
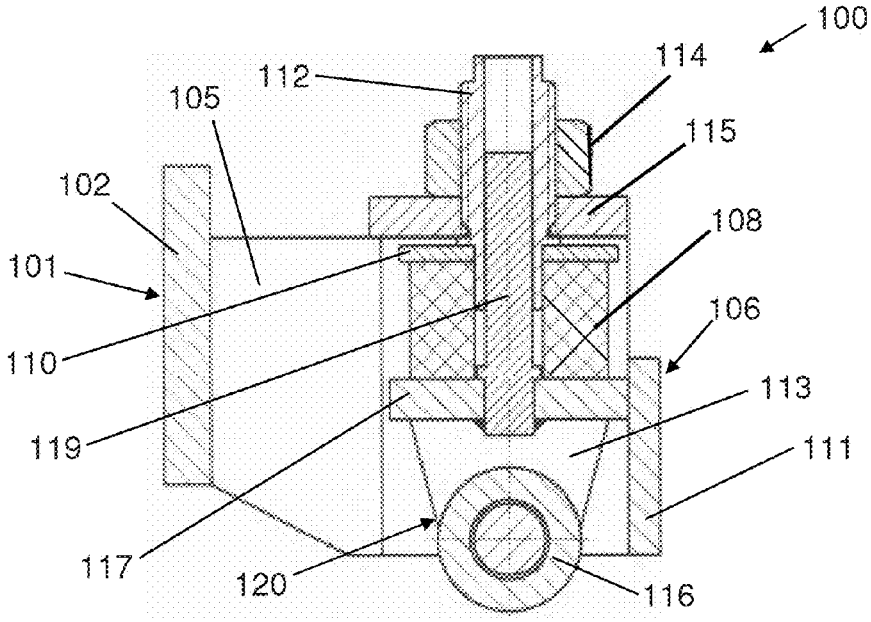
FIG. 2 is a cross-sectional view of the roller assembly of FIG. 1 taken along plane A-A of FIG. 1.
Figure 3:
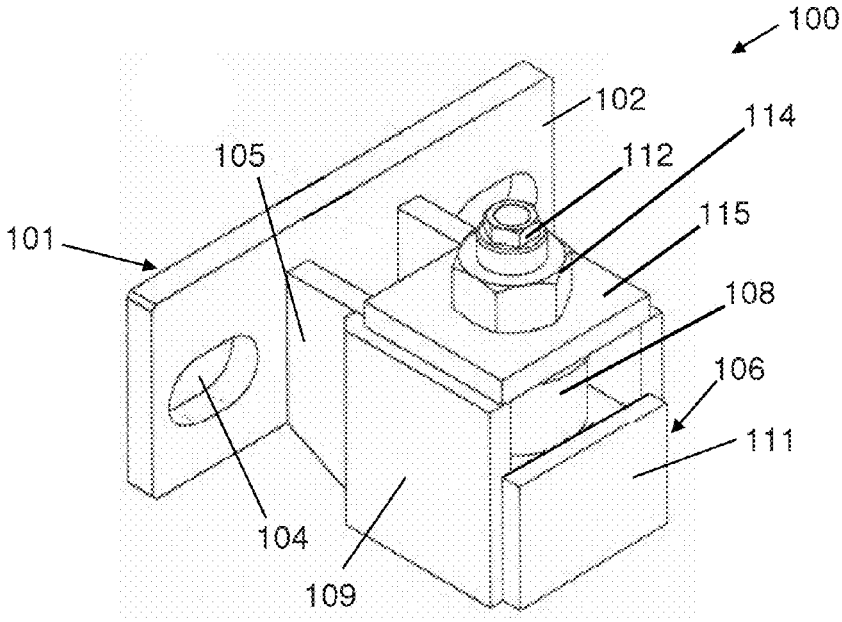
FIG. 3 is a top perspective view of the roller assembly of FIG. 1.
Figure 4:
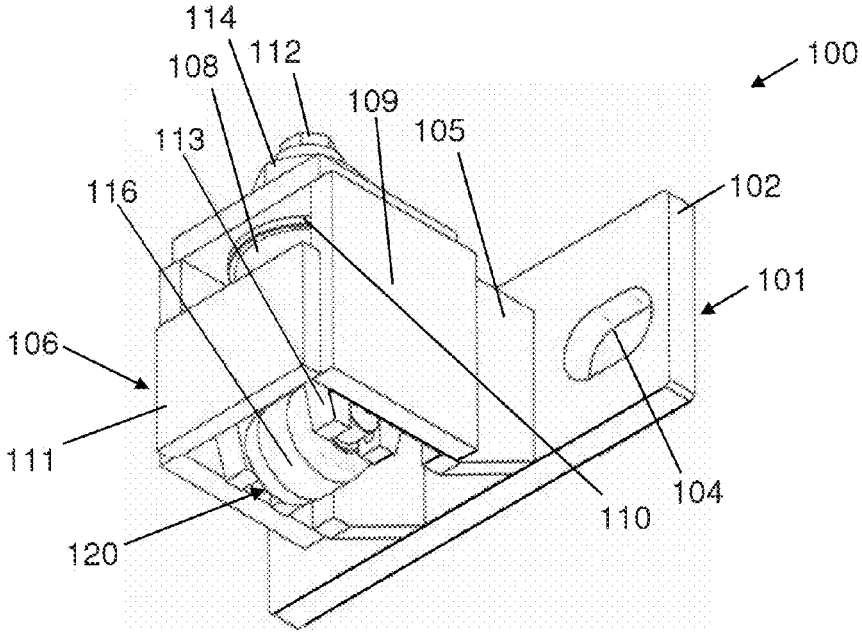
FIG. 4 is a bottom perspective view of the roller assembly of FIG. 1.
Figure 11:
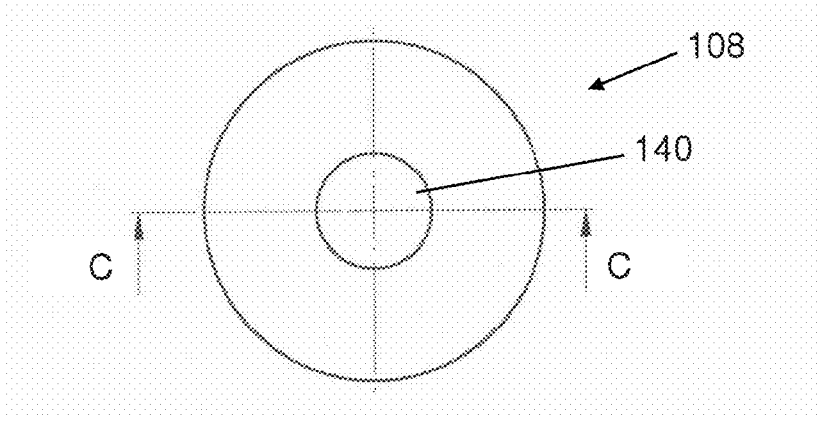
FIG. 11 is an end view of the elastomeric block of FIG. 1.
Figure 12:
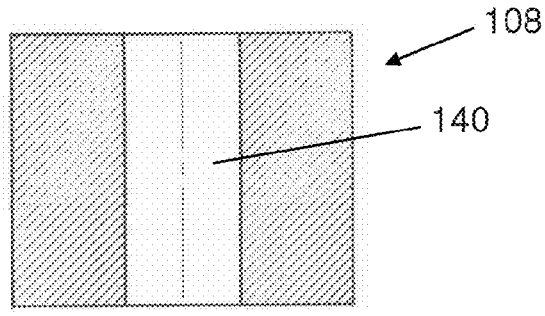
FIG. 12 is a cross-sectional view of the elastomeric block of FIG. 11 taken along plane C-C of FIG. 11.
Figure 13:
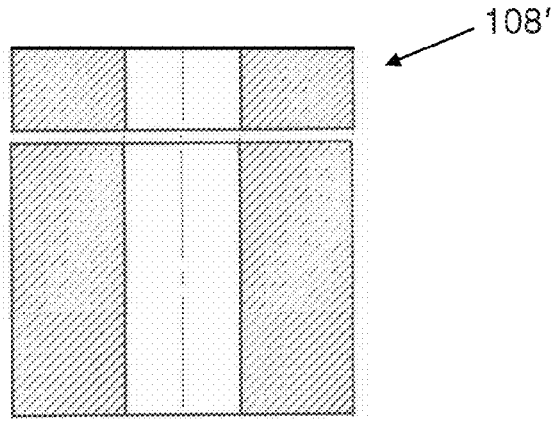
FIG. 13 is a cross-sectional view of an elastomeric block in an alternative embodiment.

FIGS. 11 and 12 show elastomeric block 108, which is a generally cylindrical elastomeric bushing having a central aperture 140 and adapted to compress under axial load, i.e., when the weight of a train is exerted on roller assembly 100. As shown in FIG. 13, in an alternative embodiment, elastomeric block 108' can include two or more separate cylindrical bushings stacked together. In this alternative embodiment, a kit with the two or more cylindrical bushings can be provided, such that adjustments for different installations having different switch-rail bolt heights can be made by stacking different combinations of cylindrical bushings to yield different heights of elastomeric block. As best seen in FIGS. 2 and 4, a washer 110 is disposed between top wall 115 and elastomeric block 108.

Figure 14:
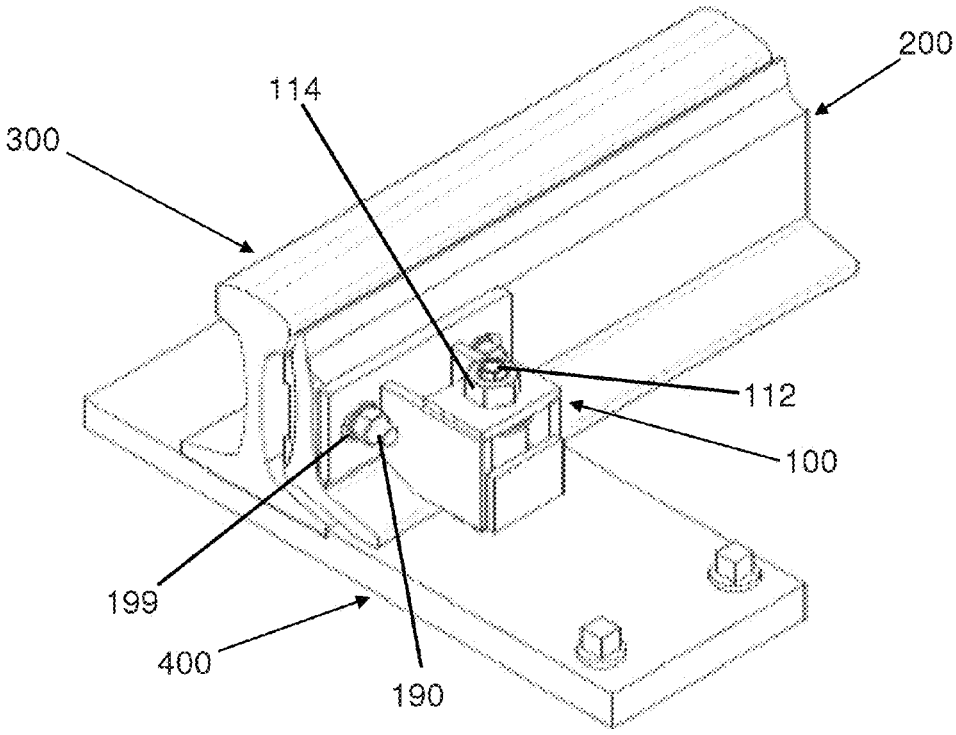
FIG. 14 is a top perspective view of the roller assembly of FIG. 1 in an exemplary installation onto a switch rail and tie plate.
Figure 15:
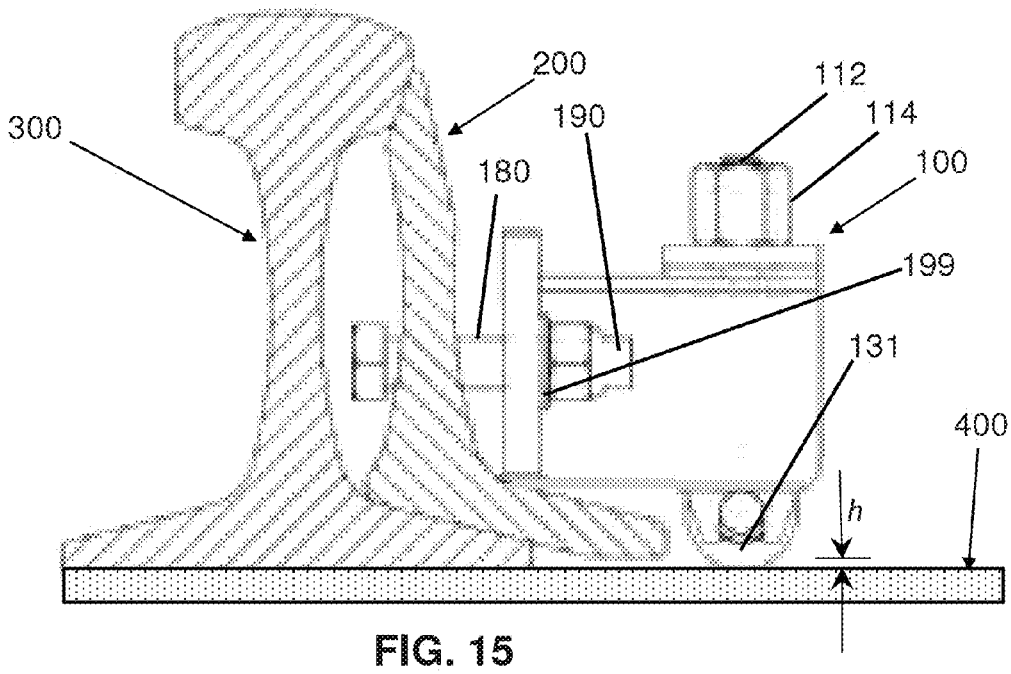
FIG. 15 is a side sectional view of the installed roller assembly of FIG. 14.

FIGS. 14 and 15 show an exemplary installation of roller assembly 100 of FIG. 1 onto a switch rail 200 and tie plate 400. As shown, roller assembly 100 is bolted to switch rail 200 with bolt 180, nut 190, and washer 199. The height of roller assembly 100 is adjusted by rotating shaft 112 of elastomer assembly 120 clockwise or counterclockwise until (i) roller wheel 131 rests on tie plate 400 and (ii) switch rail 200 is located slightly above (e.g., with adjustment height h=2 mm above tie plate 400), but not touching tie plate 400. By raising switch rail 200 off tie plate 400, friction between switch rail 200 and tie plate 400 is eliminated, since switch rail 200 can now easily roll along tie plate 400 by means of roller wheel 131, either toward or away from stock rail 300. When the weight of a train is exerted axially on roller assembly 100, the value of adjustment height h drops to h=0 due to the compression of elastomeric block 108, causing the switch point to rest across all of the tie plates when under pressure, as would normally occur at the switch absent the installation of roller assembly 100. In other words, while the train is compressing elastomeric block 108, the train rides fully on the rails, just as if roller assembly 100 were not present. Accordingly, roller assembly 100 bears only the weight of switch rail 200, and not the weight of the entire train. When no weight is exerted on roller assembly 100, roller assembly 100 assists the switch to move freely between the first and second positions.

An exemplary process for installing two pairs of roller assemblies 100 on a switch will now be described. Roller assemblies 100 are installed on both sides of the switch point, e.g., with one pair of switches close to the point and the other pair located 4 to 6 ties away from the point. The installation begins by installing the first pair of roller assemblies 100 at the front, with the switch in open position.

The switch is then thrown, and the second pair of roller assemblies 100 is installed on the other (now-open) side of the switch.

Each individual roller assembly 100 may be installed as follows. First, existing bolts or rivets are removed from the holes on the switch rail 200 selected for installation, and the tie plate 400 is cleaned to remove built-up material that could impede switch movement. Next, hex nut 114 is loosened with a wrench, and shaft 112 is rotated counterclockwise with a wrench to back roller assembly 100 fully out of adjustment. Roller assembly 100 is bolted to switch rail 200 and secured with a washer 199 and nut 190 (either a cotter pin or a lock nut may be used for additional security). It is then verified that roller assembly 100 is level with the switch point (to reduce wear on roller parts).

The height of all four roller assemblies 100 is then adjusted by rotating shaft 112 either clockwise or counterclockwise, e.g., until roller wheel 131 rests on tie plate 400 and switch rail 200 is located 2 mm above but not touching tie plate 400. Finally, the respective hex nuts 114 of all four roller assemblies 100 are tightened with a wrench. Installation of roller assembly 100 is desirably performed on the side of the switch that is in the open position, while adjustment of roller assembly 100 is desirably performed on the side of the switch that is in the closed position.

A roller assembly consistent with embodiments of the present invention has a number of advantages. Since friction between the switch rail and the tie plate is eliminated, there is no need for lubrication between these components. Raising the switch rail off the tie plate also provides reliable switch functioning in all types of weather and environments, including underwater. The roller assembly reduces labor costs by eliminating any need for drilling by using existing holes in the rail and can be installed quickly using conventional wrenches, thereby also reducing or eliminating the need to close railway traffic. Additionally, the roller assembly does not require removal during tamping, also reducing labor costs. Further, installation of the roller assembly does not require switch construction to be altered. In addition to reduced labor costs, use of the roller assembly achieves cost savings by eliminating the need to purchase lubricant and special tools, by reducing the incidence of switch failures, by reducing strain on switch motors and the need for replacement motors, by reducing traffic errors from failed switch throws, and by reducing electricity costs for driving switch motors.

Components of frame 101 are desirably formed from steel (e.g., mild steel) or similar alloy and are welded together, e.g., according to the WIG141 method of welding, using a WT20 wolfram electrode. Elastomeric block 108 is desirably formed from a heat-treated polyurethane elastomer, e.g., Urelast 90 Shore A fabricated by EFFBE GmbH of Bad Soden-Salmünster, Germany, or other elastomeric material. Roller wheel 131 is desirably formed from steel (e.g., zinc-coated galvanized steel). Other than elastomeric block 108, all of the components of roller assembly 100 are formed from metallic materials.

One or more of the frame components of a roller assembly consistent with embodiments of the invention may be painted, to protect the metal from corrosion, as well as to enhance visibility of the roller assembly once installed.

The present invention is not limited to the embodiments shown herein. According to various embodiments, the components of a roller assembly can have shapes, sizes, and configurations other than those shown and described herein.

Although the present invention was described as being used in railways, the present invention is not so limited, and may also have utility with other vehicular systems, such as tramways or roller coasters, and may also have applications outside of the field of vehicular travel.

Unless explicitly stated otherwise, each numerical value and range should be interpreted as being approximate as if the word "about" or "approximately" preceded the value of the value or range.

It will be further understood that various changes in the details, materials, and arrangements of the parts which have been described and illustrated in order to explain the nature of this invention may be made by those skilled in the art without departing from the scope of the invention as expressed in the following claims. As just one example, one or more portions of frame 101 (e.g., mounting plate 102, projections 105, sidewalls 109, front wall 111, and top wall 115) could be fabricated from one piece of material instead of being separate parts that are welded together.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

We claim:

1. A roller assembly for facilitating movement of a switch rail between a first position and a second position, the roller assembly comprising:

a frame adapted for attachment to the switch rail, the frame having a pocket formed therein; and an elastomer assembly, at least a portion of the elastomer assembly slidably disposed within the pocket, wherein the elastomer assembly comprises:

a roller wheel adapted to travel along the surface of a tie plate when the frame is attached to a switch rail and the switch rail is moved between the first position and the second position, and an elastomeric block adapted to compress under a load applied to the switch rail in the direction of the tie plate, wherein the compression of the elastomeric block under the load causes the roller wheel to travel in the direction of the pocket.

2. The invention of claim 1, wherein the elastomer assembly is adapted to permit adjustment of the distance between the roller wheel and the tie plate.

3. The invention of claim 2, wherein the elastomer assembly further comprises a shaft coupled to the roller wheel, and adjustment of the distance between the roller wheel and the tie plate is made by rotating the shaft.

4. The invention of claim 3, wherein the shaft has a bolt head formed thereon.

5. The invention of claim 3, wherein the shaft has a threaded portion formed thereon for receiving a nut to prevent adjustment of the distance between the roller wheel and the tie plate when the nut is fully threaded onto the shaft.

6. The invention of claim 1, wherein the elastomer assembly further comprises a hollow shaft coupled to the roller wheel, and the roller wheel is coupled to a plunger slidably disposed within the shaft.

7. The invention of claim 6, wherein the plunger is adapted to receive slidably thereon an elastomeric block having a hole formed therein.

8. The invention of claim 1, wherein the elastomer assembly further comprises a pair of guide plates adapted to retain a roller unit comprising the roller wheel.

9. The invention of claim 8, wherein the guide plates have one or more screw holes formed therein for receiving one or more screws adapted to retain the roller unit.

10. The invention of claim 1, wherein the roller wheel has a central portion having a substantially uniform diameter and shoulder portions that taper inward distally.

11. The invention of claim 1, wherein the elastomer assembly further comprises a roller unit comprising the roller wheel and a pivot disposed within a central aperture of the roller wheel, and the roller wheel freely rotates about the pivot.

12. The invention of claim 1, wherein the frame has a plurality of through holes formed therein for attachment of the frame to the switch rail by means of bolts.

13. The invention of claim 1, wherein the elastomer assembly has first and second ends and comprises an elastomeric block disposed at the first end and a roller assembly comprising the roller wheel disposed at the second end.

14. The invention of claim 1, wherein the pocket comprises a pair of sidewalls, a front wall, and a top wall.

15. The invention of claim 1, wherein the front wall has a smaller height relative to the height of the sidewalls.

16. The invention of claim 1, wherein the elastomeric block comprises a plurality of elastomeric members stacked together.

17. The invention of claim 1, wherein the elastomeric block comprises a unitary elastomeric member.

18. The invention of claim 1, wherein, if the roller assembly is attached to the switch rail and no load is applied to the switch rail in the direction of the tie plate, then the roller assembly lifts the switch rail off the tie plate.

* * * * *